United States Patent [19]

McGrane

[11] Patent Number: 4,968,857

[45] Date of Patent: Nov. 6, 1990

[54] SUBMERSIBLE SPLICE AND SPLICE COVER ASSEMBLY

[75] Inventor: Eugene W. McGrane, Ormond Beach, Fla.

[73] Assignee: Homac Mfg. Company, Ormond Beach, Fla.

[21] Appl. No.: 403,439

[22] Filed: Sep. 6, 1989

[51] Int. Cl.[5] ..... H01R 4/70; H01R 4/20

[52] U.S. Cl. ..... 174/84 C; 174/138 F

[58] Field of Search ..... 174/84 R, 84 C, 84 S, 174/138 F; 29/862, 871

[56] References Cited

U.S. PATENT DOCUMENTS

| | | | |
|---|---|---|---|
| 2,917,569 | 12/1959 | Senior, Jr. | 174/84 C |
| 3,404,216 | 10/1968 | Amann et al. | 174/84 C |
| 4,208,788 | 6/1980 | Siden | 174/84 CX |
| 4,839,470 | 6/1989 | Ventura | 174/84 CX |

*Primary Examiner*—Laramie E. Askin

*Attorney, Agent, or Firm*—John E. Benoit

[57] ABSTRACT

A submersible splice assembly which includes a splice and a mating splice cover. The splice and splice cover are configured such that the splice cover is centered about the splice. As interference fit between the splice and splice cover is also provided.

2 Claims, 1 Drawing Sheet

SUBMERSIBLE SPLICE AND SPLICE COVER ASSEMBLY

This invention relates generally to splices and splice covers and more particularly to submersible splices and splice covers forming a watertight assembly.

BACKGROUND OF THE INVENTION

Underground residential electric and distribution systems have primary and secondary voltage cables direct-buried in trenches, usually at curbside. To maintain the watertight integrity of these systems, all cable connectors, including splices, are insulated watertight.

Advances in rubber technology have generated the development of EPDM rubber splice covers, which are now in common use. They have largely eliminated the use of tape and various compounds for insulating splices because of the considerable installed cost for these systems. The use of EPDM rubber splice covers substantially reduces such costs. Splice covers have also been applied over splices and cables by heat-shrinking. This not only requires expensive equipment at the site, but also means that the cover must be destroyed in order to have access to the splice. Accordingly, EPDM splice covers which are slidable along the cables and the splice itself are now in use.

The splice assemblies that are the subject of this invention are generally for use on cables rated up to 600 volts. A typical splice cover includes an interference fit about the cables where the ends of the splice cover meet with the cables. The interior of the splice cover, however, normally does not present an interference fit with the splice, but commonly includes an air space between the interior of the splice cover and the splice itself.

While properly designed EPDM splice covers of the type discussed above provide consistent watertight assemblies, it is important that the splice cover be installed centrally with respect to the splice. This ensures that the sealing interfaces between the splice cover and the cable insulation at each end of the splice cover are adequate to provide the required watertight seals. If the splice cover is installed off-center to the point where the bearing interface at one end of the splice cover assembly is substantially reduced in length, its watertight integrity could be impaired, resulting in failure and an electrical outage.

Accordingly, it is an object of this invention to provide a positive means of centering splice covers about splices to avoid off-center assemblies.

A further object of this invention is to provide an interference fit between the splice and the splice cover used in underground electrical connectors.

Other objects of the invention will become obvious from the following description taken together with the drawings.

DETAILED DESCRIPTION OF THE PREFERRED EMBODIMENTS

Figure 1:
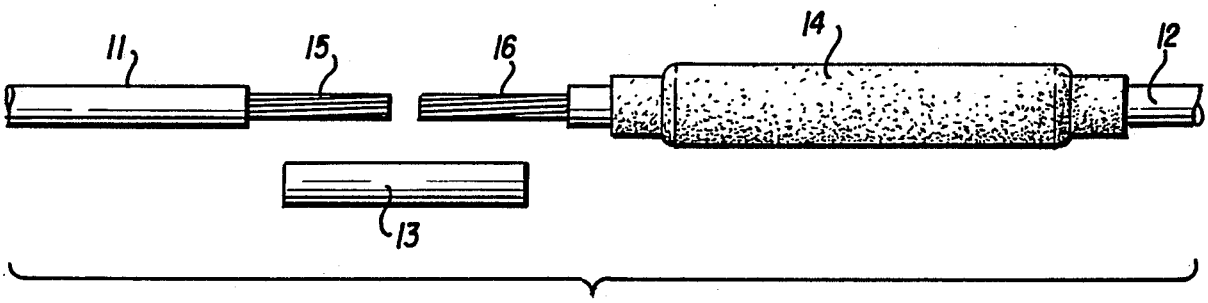
FIG. 1 (PRIOR ART)
FIG. 1 is an exploded view of a splice, cover, and cable of the prior art.
Figure 2:
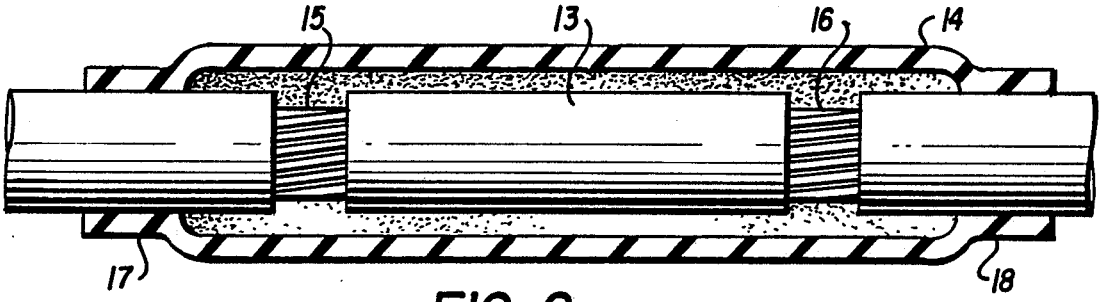
FIG. 2 (PRIOR ART)
FIG. 2 is a partial sectional view of the splice of FIG. 1 assembled.

FIGS. 1 and 2 illustrate a deformable metal splice and removable splice cover used in the prior known art. In FIG. 1, insulated cables 11 and 12 are shown with a typical EPDM splice cover 14 being positioned on one of the insulated cables prior to assembly. Cable ends 15 and 16 are shown with the insulation removed. Splice 13 is a standard deformable metallic splice.

In FIG. 2, splice 13 has been installed on cable ends 15 and 16 and crimped, and splice cover 14 has been assembled in place over the cables and the splice. Ends 17 and 18 are of a dimension smaller than the insulated cables and, therefore, provide interference fits with the cable insulation at each end of the splice cover.

While the assembly of FIGS. 1 and 2, when properly designed, provides consistent watertight assemblies, it is important that the splice cover be installed centrally with respect to the splice. This ensures that the sealing interfaces between the splice cover and the cable insulation at each end of the splice cover are adequate to obtain the required watertight seals. If the splice cover is installed off-center to the point where the bearing interface between the cable and the splice cover at one end of the splice cover assembly is substantially reduced in length, its watertight integrity could be impaired. This could result in failure and a resultant electrical outage. The splice cover of FIGS. 1 and 2 is adjusted by eye, only, and includes no means for assuring that the cover will be centrally located over the splice.

Figure 3:
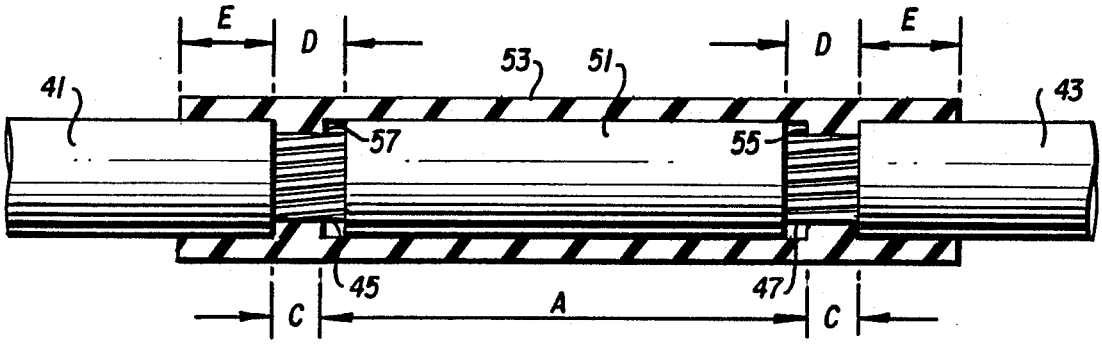
FIG. 3 is a partial sectional view of the modified splice and splice cover of the present invention.

Turning now to FIG. 3, there is shown the splice cover of the present invention having means for locating the splice cover centrally over a standard splice 51 which is crimped over cable ends 45 and 47.

Insulated cables 41 and 43 terminate in bare cable ends 45 and 47, which have had the insulation stripped away. These cable ends are shown as having already been secured within splice 51, with splice cover 53 located over insulated cables 41 and 43 and splice 51 so as to provide an interference fit over substantially all of the splice and the portions of the cables covered by the splice cover.

Splice cover 53 includes splice stops 55 and 57, which are integral with splice cover 53 and, accordingly, are made of the same material. Splice stops 55 and 57 extend about the inner periphery of splice cover 53. The distance A between splice cover stops 55 and 57 is at least as great as the longitudinal length of splice 51 after installation. Due to compression, the splice is longer after installation and the extended length must be accommodated with the splice cover. The inside diameters of stops 55 and 57 are smaller than the outside diameter of the splice. Preferably, the width C of splice cover stops 55 and 57 is so designed as to provide a space between the stop and the ends of splice 51 so as to accommodate for any variations in splice lengths which occur as a result of compression during installation. Accordingly, the distance D between the end of the cable insulation 43 and splice 51 is greater than the width C of splice cover stops 55 and 57. The distance E between the splice cover stop and the end of the splice cover is established so as to be of a length to ensure that the interference fit with cables 41 and 43 is sufficient to maintain a watertight integrity between the cables and the splice cover. The distances E are substantially the same. Again, an interference fit is maintained between splice cover 53, splice 51, and insulated cables 41 and 43. As will be obvious, this ensures a central location of the splice cover over the splice and the interference fit also provides the efficient heat transfer from the splice, which is not available when areas of air exist between the splice and the splice cover.

As will now be apparent, the present invention assures that the splice cover will be substantially centered over the splice and that an interference fit is provided between the splice and the splice cover.

The above description and drawings are illustrative only since variations in specific components could be made without departing from the invention, the scope of which is to be limited only by the following claims.

I claim:

1. Submersible splice apparatus for interconnecting insulated cables, said apparatus comprising a deformable metal splice having a predetermined longitudinal length;

a resilient splice cover slidably secured about and removable from said deformable splice, said splice cover having a longitudinal length greater than the longitudinal length of said splice and having an internal diameter smaller than the outer diameter of said splice so as to ensure an interference fit when said cover is placed over said splice, the ends of said splice cover adapted to provide an interference fit about insulated cables used with said splice; and first and second splice stops integral with said splice cover and extending from the internal surface of said splice cover, said first splice stop being located at a predetermined distance from one end of said splice cover and said second splice stop being located at substantially the same predetermined distance from the other end of said splice cover, the distance between said first and second splice stops being greater than the longitudinal length of said splice.

2. The submersible splice apparatus of claim 1 wherein said splice stops extend about the inner periphery of said splice cover and have an inner diameter smaller than the outer diameter of said splice.

* * * * *